United States Patent [19]

Tagawa et al.

[11] Patent Number: 4,890,798

[45] Date of Patent: Jan. 2, 1990

[54] STRUCTURE CRUSHING EQUIPMENT

[75] Inventors: Itsuo Tagawa, Tokyo; Yukiharu Kanari; Samon Kanno, both of Saitama; Takaharu Kozaki, Tokyo, all of Japan

[73] Assignee: Sangojuuki Co., Ltd., Tokyo, Japan

[21] Appl. No.: 326,817

[22] Filed: Mar. 21, 1989

[51] Int. Cl.[4] ..... B02C 1/06; B02C 1/10

[52] U.S. Cl. ..... 241/266; 241/101.7; 299/70

[58] Field of Search ..... 241/101.7, 264, 266; 299/14, 15, 69, 70

[56] References Cited

U.S. PATENT DOCUMENTS

| | | | |
|---|---|---|---|
| 4,196,862 | 4/1980 | Tagawa | 241/101.7 X |
| 4,512,524 | 4/1985 | Shigemizu | 241/101.7 |
| 4,776,524 | 10/1988 | Sakato | 241/101.7 |

FOREIGN PATENT DOCUMENTS

| | | |
|---|---|---|
| 6128839 | 5/1979 | Japan . |
| 58785 | 7/1980 | Japan . |
| 6061336 | 10/1983 | Japan . |
| 61-162675 | 7/1986 | Japan . |

*Primary Examiner*—Timothy V. Eley
*Attorney, Agent, or Firm*—Lowe, Price, LeBlanc, Becker & Shur

[57] ABSTRACT

An equipment adapted to be installed on a working machine, for crushing a structure. A hydraulic piston-cylinder unit is mounted to a bracket member to be mounted to the wording machine, for angular movement relative to the bracket member about an axis of a piston rod of the hydraulic piston-cylinder unit. At least one of a pair of opposed arms has a forward end provided with a crushing member. The pair of arms are operatively connected to the piston rod for pivotal movement, between closed and open positions, toward and away from each other and toward and away from a plane including an axis of the piston rod. A wall of a cylinder of the piston-cylinder unit is formed with passageway supplying hydraulic fluid from a hose unit of the working machine, into the cylinder. A rotatable coupling enables the passageway and the hose unit to communicate with each other, even when the piston-cylinder unit moves angularly about the axis of the piston rod relatively to the bracket member.

17 Claims, 4 Drawing Sheets

STRUCTURE CRUSHING EQUIPMENT

BACKGROUND OF THE INVENTION

The present invention relates to an equipment adapted to be installed on a working machine such as, for example, a power shovel or the like, for crushing a structure such as reinforced concrete or the like.

Conventionally, pulling-down operation or working of an existing building attendant upon construction work or the like has been effected in the following manner. That is, crushing and removal of a concrete structure rely upon methods of construction such as crushing due to a rock drill of air-hammer type, destruction due to striking of a large steel ball, and so on. However, these methods of construction have various problems. That is, the methods of construction cause violent noises and vibration, resulting in a problem of environmental pollution. Further, the methods of construction require a large working space, and are also accompanied with danger.

In recent years, a structure crushing instrument has been developed, which is of type in which hydraulic pressure is utilized to clamp the structure to crush the same at low noise. A method of construction has widely been employed, in which the structure crushing equipment is mounted to a working machine such as a power shovel or the like as an attachment, to crush the structure. Furthermore, since the structure includes reinforcement, pipes, steel frames and so on, an apparatus has also been developed, in which the crushing instrument is additionally provided with a tool for squashing the reinforcement and so on and for cutting the same.

The above-described crushing equipment comprises a pair of arms whose respective forward ends are generally provided with crushing blades and/or cutting blades for clamping, crushing and cutting the structure. Intermediate portions of the respective arms are pivotally mounted to and are supported by a frame. Rearward ends of the respective arms are connected to a piston rod of a hydraulic piston-cylinder unit. The pair of arms are arranged such that actuation of the piston rod causes the blades on the forward ends of the respective arms to be moved toward and away from each other, thereby clamping the structure. In such crushing equipment, however, the hydraulic piston-cylinder unit is so arranged that the piston rod moves parallel to a tangent line or a moving locus of the arms. That is, the hydraulic piston-cylinder unit is arranged perpendicularly to the center line of the crushing equipment, i.e., the clamping center line between the crushing blades. By this reason, the width of the entire crushing equipment increases, making the operation in a narrow space difficult.

In view of the above, a structure crushing equipment has been proposed, in which a hydraulic piston-cylinder unit is mounted longitudinally or vertically to a bracket member to be mounted to a working machine, and actuation of the cylinder is transmitted to a pair of arms through a link mechanism, thereby moving crushing blades toward and away from each other. Such crushing equipment is disclosed in, for example, Japanese patent publication No. Sho 58-785, Japanese utility model application laid-open No. Sho 60-61336 or the like.

In the crushing equipment of vertical cylinder type described above, the moving direction, that is, the clamping direction of the crushing blades is determined depending upon attachment of the bracket member of the crushing equipment to the boom of the working machine. Therefore, it is impossible to alter the posture of the crushing equipment unless the working machine is moved and swiveled. In the actual structure crushing working, the clamping force of the crushing blades cannot necessarily be applied to an object to be crushed, always in an appropriate direction, depending upon the configuration of the object and the relative position between the working machine and the object. For example, a case often occurs when the crushing blades are abutted obliquely against the faces of the concrete wall. By this reason, the clamping force of the crushing blades does not effectively act upon the object to be crushed, resulting in a decrease in the working performance. Further, reaction force from the structure causes the crushing blades to be twisted so that wear or damage occurs in the cutting blades.

In view of the above, a crushing equipment has been considered in which a hydraulic piston-cylinder unit is made angularly movable relatively to the boom of the working machine. In this case, however, since hydraulic-fluid supply ports move in their positions in accordance with the angular movement of the hydraulic piston-cylinder unit, hoses feeding hydraulic fluid from a hydraulic fluid source installed on the working machine, to the cylinder is required to be lengthened. By this reason, accidents tend to occur such as winding of the hoses around the working machine, twining of the hoses around each other, breaking of the hoses and so on. As countermeasures of such accidents, a hydraulic-fluid supply device is employed which is of rotary valve type disclosed in for example, Japanese patent application No. Sho 61-162675. However, the hydraulic-fluid supply device is complicated in construction, and is many in number of component parts and, therefore, a malfunction of fluid leakage often occurs due to shock at the crushing working, surge pressure of the hydraulic cylinder, impingement of scattering crushed pieces, or the like.

The conventional crushing equipment disclosed in, for example, the aforesaid Japanese utility model application laid-open No. Sho 60-61336 is arranged such that the cylinder of the hydraulic piston-cylinder unit moves vertically to actuate the link mechanism. Since the cylinder moves while pins or the like provided on the cylinder are guided by guide slots, guide grooves or the like, concrete waste, reinforcement waste or the like tends to enter the guide sections to lodge the same, resulting in causes of inoperativeness and malfunction.

Apart from the above, when a reinforced concrete structure such as a building or the like is destroyed, a mixture of the reinforcement and the concrete lumps is produced. Accordingly, as a post-treatment after the destruction of the structure, workings or operations are required such as working for separating the reinforcement and the concrete lumps in the mixture from each other, working for crushing the concrete lumps to small pieces for use as crushed stones for roadway, and so on.

As the crushing equipment for use in such post-treatment, a crushing equipment is known which is disclosed in, for example, Japanese patent publication No. Sho 61-28839. The known crushing equipment is arranged such that concrete lumps are crushed to small pieces by a bucket-like member having a stationary blade and a movable blade.

The crushing equipment of the type described above has such a problem that the crushing equipment cannot well scoop up the mixture of the concrete lumps and the reinforcement, because of hindrance of the reinforcement. Accordingly, when it is desired to crush the concrete lumps to small pieces, the concrete lumps and the reinforcement are first separated from each other by an equipment separate from the crushing equipment, and then the concrete lumps are accumulated in heaps so as to become easy to be scooped up. Subsequently, the concrete lumps are scooped up by a crushing equipment like one described above, and are crushed by the same. In this manner, since the concrete lumps and the reinforcement are intertwined with each other and the concrete lumps are bonded to the reinforcement, working is required for crushing the concrete lumps to small pieces, thereby separating the concrete lumps from the reinforcement. It is desirable that crushing of the concrete lumps and separation of the concrete lumps and the reinforcement from each other are treated simultaneously and parallel with each other. To this end, an equipment is desirable in which crushing of the concrete lumps and separation of the concrete lumps and the reinforcement from each other to accumulate the concrete lumps can be carried out by the single equipment.

SUMMARY OF THE INVENTION

It is an object of the invention to provide a structure crushing equipment which is less in malfunction and is capable of efficiently pulling down and crushing the structure.

It is another object of the invention to provide a structure crushing equipment in which clamping and carrying-away of reinforcement or the like and crushing of concrete lumps to small pieces can be carried out by the single crushing equipment, so that separation of the concrete lumps and the reinforcement from each other and crushing of the concrete lumps can be effected parallel with each other.

According to the invention, there is provided an equipment adapted to be installed on a working machine, for crushing a structure, the equipment comprising:

bracket means to be mounted to the working machine;

hydraulic piston-cylinder means having a cylinder and a piston rod and mounted to the bracket means for angular movement relative thereto about an axis of the piston rod;

frame means associated with the hydraulic piston-cylinder means for angular movement therewith about the axis of the piston rod;

a pair of opposed arms mounted to the frame means for pivotal movement relative thereto, between a closed position and an open position, toward and away from each other and toward and away from a plane including the axis of the piston rod of the hydraulic piston-cylinder means, the piston rod being operatively connected to the pair of arms for moving the same between the closed and open positions, at least one of the pair of arms having its forward end portion provided with crushing means, the crushing means on the forward end portion of the one arm cooperating with the other arm to clamp therebetween the structure for crushing the same;

passage means provided in a wall of the cylinder, wherein hydraulic fluid from hydraulic-fluid supply hose means of the working machine can be supplied into the cylinder through the passage means; and rotatable coupling means associated with the cylinder for enabling the passage means and the hydraulic-fluid supply hose means to communicate with each other even when the piston-cylinder means moves angularly about the axis of the piston rod relatively to the bracket means.

In the crushing equipment according to the invention, the hydraulic piston-cylinder means is arranged such that the pair of arms move between the open and closed positions toward and away from the plane including the axis of the piston rod. With the arrangement, the entire equipment can be made compact in construction, making it possible to improve the workability in a narrow space. Further, since the piston-cylinder means is protected by the frame means and the bracket means, it is possible to effectively prevent the piston-cylinder means from being damaged due to impingement of crushed pieces against the piston-cylinder means. Moreover, since the center of gravity of the crushing equipment can be located adjacent the working machine, swiveling of the working machine is made easy.

Furthermore, since the arrangement is such that the piston-cylinder means is angularly movable together with the arms, the crushing equipment can clamp and crush the object to be crushed with the optimum posture in accordance with the object, making it possible to improve the working efficiency. Further, the arms are prevented from being twisted by the reaction force from the object, and it can be dispensed with to provide guide sections such as slots so that the guide sections are prevented from being clogged by foreign matter. Thus, malfunction of the equipment can considerably be reduced. Moreover, since the rotatable coupling means is associated with the cylinder, it can be dispensed with to use long hydraulic-fluid hose means so that it is possible to avoid accidents such as catching of the hose means, twining thereof, and so on.

According to the invention, there is further provided an equipment adapted to be installed on a working machine, for crushing a structure, the equipment comprising:

a drive source; and a pair of arms driven by the drive source for pivotal movement toward and away from each other between an open position and a closed position, the pair of arms having their respective sides opposed to each other, the sides being formed respectively into concave arcuate configurations so that, when the pair of arms are in the closed position, forward ends of the respective arms are intersected with each other, the forward end of at least one of the pair of arms being provided with crushing means, the crushing means on the one arm cooperating with the other arm to clamp therebetween the structure for crushing the same, wherein the other arm is composed of a plurality of spaced arm elements and at least one connecting element for connecting the arm elements to each other.

In the structure crushing equipment constructed as above, it is made possible for the single crushing equipment to clamp and carry away the reinforcement or the like, and to crush the concrete lumps to small pieces. Accordingly, the concrete lumps can be separated from the reinforcement and can be accumulated. At this time, the other arm can scoop up the concrete lumps to accumulate the same in heaps, and the pair of arms can also crush the concrete lumps to small pieces. Moreover, the pair of arms can grip the reinforcement one by one, and carry the reinforcement away to accumulate the same on a predetermined location. Accordingly, the conventional working, in which an equipment for reducing the concrete lumps is attached to the working machine such as a power shovel or the like to reduce the concrete lumps, an equipment for carrying the reinforcement is then attached to the working machine to accumulate the reinforcement and, subsequently, the concrete lumps are accumulated, can be carried out by the single equipment according to the invention. Thus, attachment and replacement of the equipment can be made easy, so that the post-treatment after destruction of the reinforced concrete structure can be effected efficiently.

DETAILED DESCRIPTION

Figure 1:
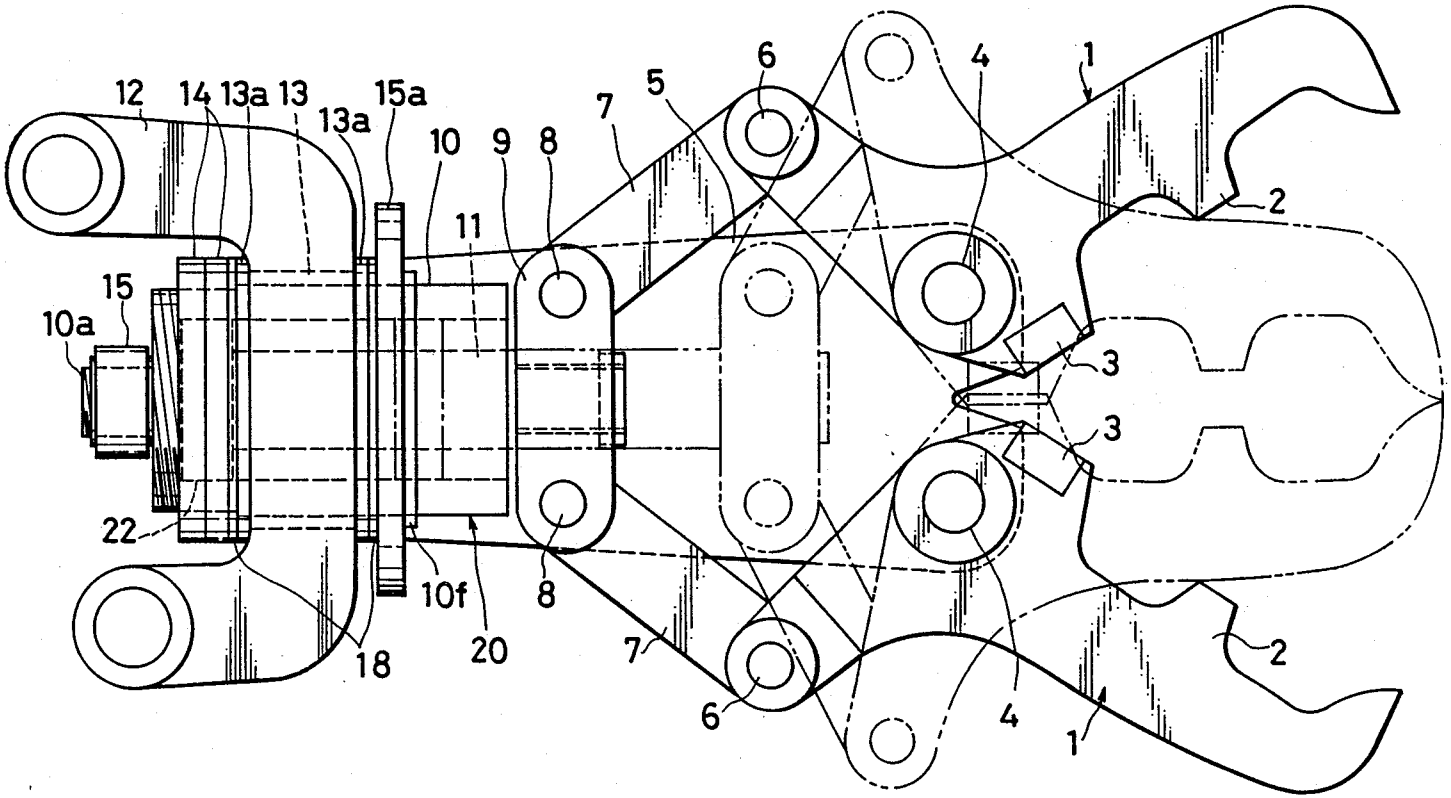
FIG. 1 is a plan view of a structure crushing equipment according to an embodiment of the invention, a state being indicated by the solid lines in which a piston rod is retracted into a cylinder so that a pair of arms are in an open position, and a state being indicated by the single-dotted lines in which the piston rod is extended out of the cylinder so that the pair of arms are in a closed position.
Figure 2:
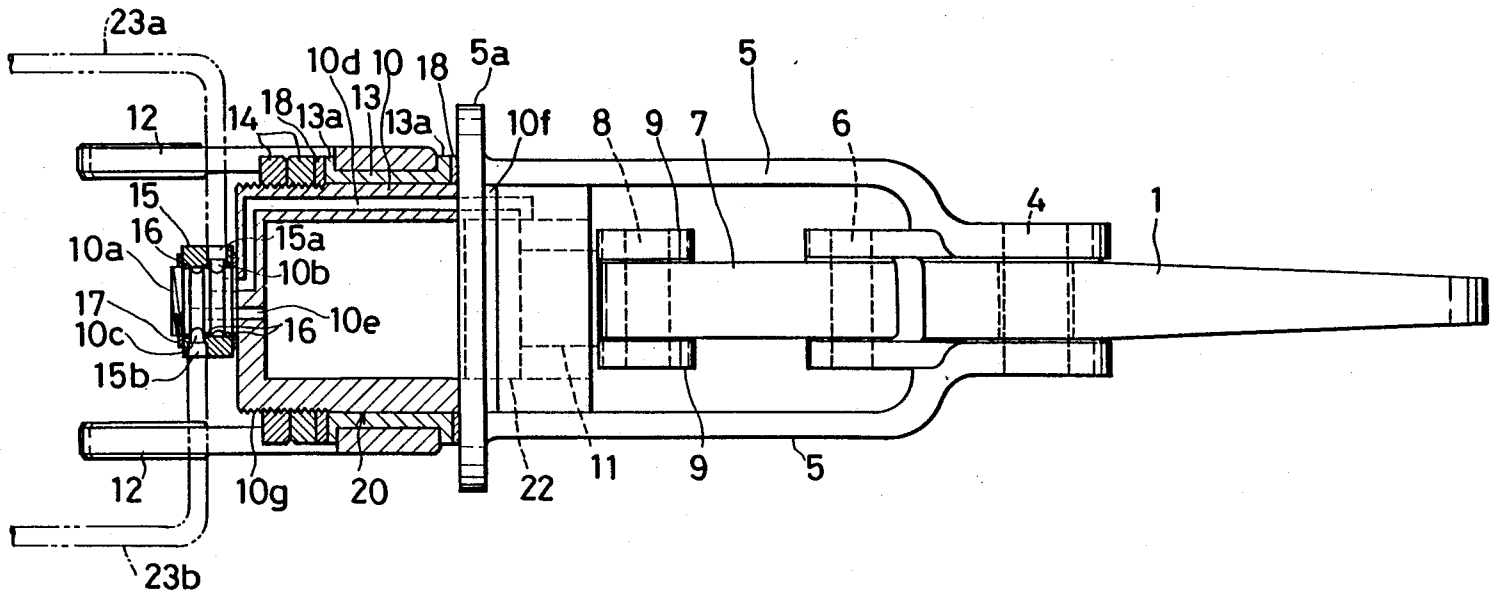
FIG. 2 is a partially cross-sectional side elevational view of the structure crushing equipment illustrated in FIG. 1, showing the state in which the piston rod is extended out of the cylinder.
Figure 3:
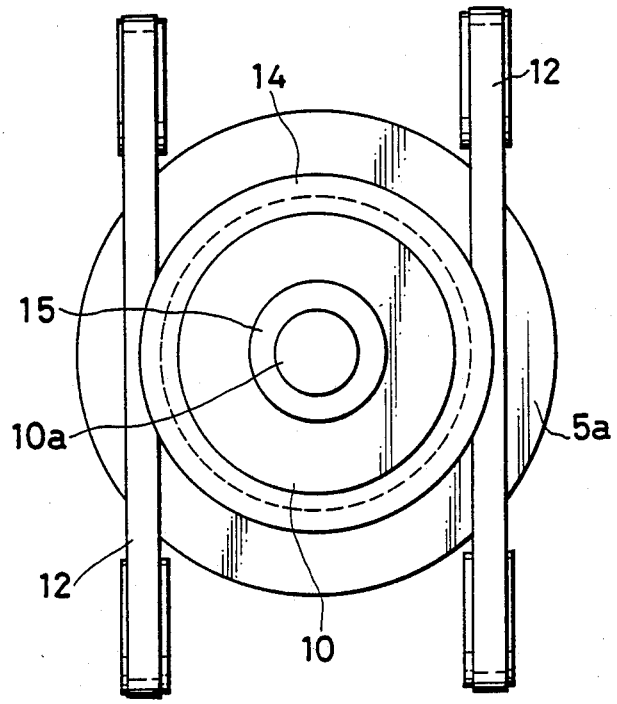
FIG. 3 is a left-hand end view of the structure crushing equipment illustrated in FIGS. 1 and 2.

Referring first to FIGS. 1 through 3, there is illustrated a structure crushing equipment according to an embodiment of the invention. The structure crushing equipment comprises a pair of arms 1 and 1 each of which has an L-shape. Sides of the pair of arms 1 and 1, which are opposed to each other, are provided with crushing blades 2 and 2, respectively. The opposed sides of the respective arms 1 and 1 are also provided respectively with cutting blades 3 and 3 which are spaced respectively from the crushing blades 2 and 2. The pair of arms 1 and 1 have their respective intermediate portions which are pivotally mounted, between a pair of frame side plates 5 and 5, to opposite sides of forward ends of the respective frame side plates 5 and 5 through pins 4 and 4. The pair of frame side plates 5 and 5 are spaced a predetermined distance from each other, but are opposed to each other. The aforesaid cutting blades 3 and 3 are located respectively adjacent the intermediate portions of the pair of arms 1 and 1. In this connection, FIG. 1 shows the structure crushing equipment, with one of the pair of frame side plates 5 and 5 removed for clarification.

A link mechanism is composed of a pair of links 7 and 7 and a connecting member 9. The pair of links 7 and 7 have their respective one ends which are pivotally connected respectively to the rear ends of the pair of arms 1 and 1 through pins 6 and 6. The connecting member 9 has its opposite ends which are pivotally connected respectively to the other ends of the pair of links 7 and 7 through pins 8 and 8.

A hydraulic piston-cylinder unit 20 serving as a drive source has a cylinder 10 and a piston rod 11. The aforesaid connecting member 9 is fixedly mounted to the piston rod 11. When the piston-cylinder unit 20 is actuated to extend and retract the piston rod 11, the link mechanism composed of the links 7 and 7 and the connecting member 9 converts the motion of the piston rod 11 to pivotal movement of the pair of arms 1 and 1 about axes of the respective pins 4 and 4 between an open position indicated by the solid lines in FIG. 1 and a closed position indicated by the single-dotted lines. Specifically, movement of the piston rod 11 causes the pair of arms 1 and 1 to be moved pivotally toward and away from each other and toward and away from a plane including the axis of the piston rod 11 between the open and closed positions.

The cylinder 10 of the hydraulic piston-cylinder unit 20 is fitted in a common flange 5*a* provided at the rear ends of the frame side plates 5 and 5 in such a manner that an extension line of the axis of the piston rod 11 is perpendicular to a tangent line of a moving locus of the pair of arms 1 and 1, that is, the extension line of the axis of the piston rod 11 coincides with the center line between the pair of arms 1 and 1, as will be understood from the foregoing. Further, the cylinder 10 is fitted in a tubular housing 13 through a pair of bushings 18 and 18. The tubular housing 13 is fixedly mounted, by means of welding or the like, to a bracket member 12 which is to be mounted to a boom (not shown) of the working machine. The cylinder 10 has its outer peripheral surface formed with threads 10*g* adjacent a rear closed end wall of the cylinder 10 opposite to a front end wall thereof through which the piston rod 11 extends. A pair of nuts 14 and 14 are threadedly engaged with the threads 10*g*. The common flange 5*a* of the frame side plates 5 and 5, the tubular flange 18 and the pair of bushings 18 and 18 are clamped between a flange 10*f* integrally fixed to the cylinder 10 and the pair of nuts 14 and 14. Thus, the cylinder 10 is arranged within the tubular housing 13 for angular movement relative thereto about the axis of the piston rod 11, but against movement axially of the piston rod 11. That is, flanges 13*a* and 13*a* provided respectively at opposite axial ends of the tubular housing 13 are clamped between the pair of nuts 14 and 14 and the flange 10*f* through the pair of bushings 18 and 18 and the flange 5*a*, whereby the cylinder 10 is supported angularly movably about the axis of the piston rod 11. When force tending to move the cylinder 10 angularly about the axis of the piston rod 11 acts upon the pair of arms 1 and 1, the arms 1 and 1 move angularly together with the frame side plates 5 and 5 and the cylinder 10 relatively to the bracket member 12.

The rear closed end wall of the cylinder 10 is provided with a projection 10*a* having a circular cross-section. The projection 10*a* has an outer peripheral surface which is formed with a pair of parallel annular grooves 10*b* and 10*c*. One of the pair of annular grooves 10*b* communicates with one of a pair of working chambers defined by a piston 22 within the cylinder 10, through a passage 10*d* provided in the wall of the cylinder 10. The annular groove 10*c* communicates with the other working chamber through a passage 10*e* which extends through the rear closed end wall of the cylinder 10. A ring 15 serving as rotatable coupling means is fitted rotatably about the projection 10*a* in concentric relation thereto. The ring 14 is fitted rotatably about the projection 10*a* through three spaced o-rings 16, and is prevented from moving away from the body of the cylinder 10, by a snap ring 17. The ring 15 is formed in its wall with a pair of hydraulic-fluid supply ports 15*a* and 15*b* which open respectively to the annular grooves 10*b* and 10*c*. A pair of hydraulic hoses 23*a* and 23*b* from a hydraulic fluid source on the working machine, as indicated by the double-dotted lines in FIG. 2, can be connected respectively to the hydraulic-fluid supply ports 15*a* and 15*b*. Thus, even when the cylinder 10 moves angularly about the axis of the piston rod 11, the annular grooves 10*b* and 10*c* always open respectively to the hydraulic-fluid supply ports 15*a* and 15*b*, so that it is effectively prevented to interrupt the supply of the hydraulic fluid.

The operation of the structure crushing equipment constructed as above according to the invention will be described below.

When the hydraulic piston-cylinder unit 20 is actuated to extend and retract the piston rod 11, the pair of arms 1 and 1 move between the closed and open positions through the links 7 and 7 and the connecting member 9. The crushing blades 2 and 2 cooperate with each other to clamp therebetween the structure to crush the same. Further, as occasion demands, the cutting blades 3 and 3 cooperate with each other to cut the reinforcement and so on. At this time, if the face of the object to be crushed such as a concrete structure is not perpendicular to the moving locus of the arm 1 and 1, the face of the object is abutted one-sidedly against one of the pair of arms 1 and 1. When the arms 1 and 1 are moved toward the closed position in the one-sided abutting state, the one-sidedly abutted arm 1 causes force moving the piston-cylinder unit 20 angularly about the axis of the piston rod 11. The piston-cylinder unit 20 is moved angularly together with the frame side plates 5 and 5 and the arms 1 and 1 such that the arms 1 and 1 are abutted against the faces of the object perpendicularly thereto. Accordingly, the arms 1 and 1 impart crushing or squashing force perpendicularly to the faces of the object to crush the same. In this manner, the arm 1 and 1 can move angularly and can alter their orientation freely depending upon the configuration and posture of the object automatically at the crushing working. Further, since the cylinder 10 of the piston-cylinder unit 20 is provided with the rotatable coupling means formed by the ring 15, the hydraulic fluid can be supplied to the working chambers within the cylinder 10 without any difficulty.

Figure 4:
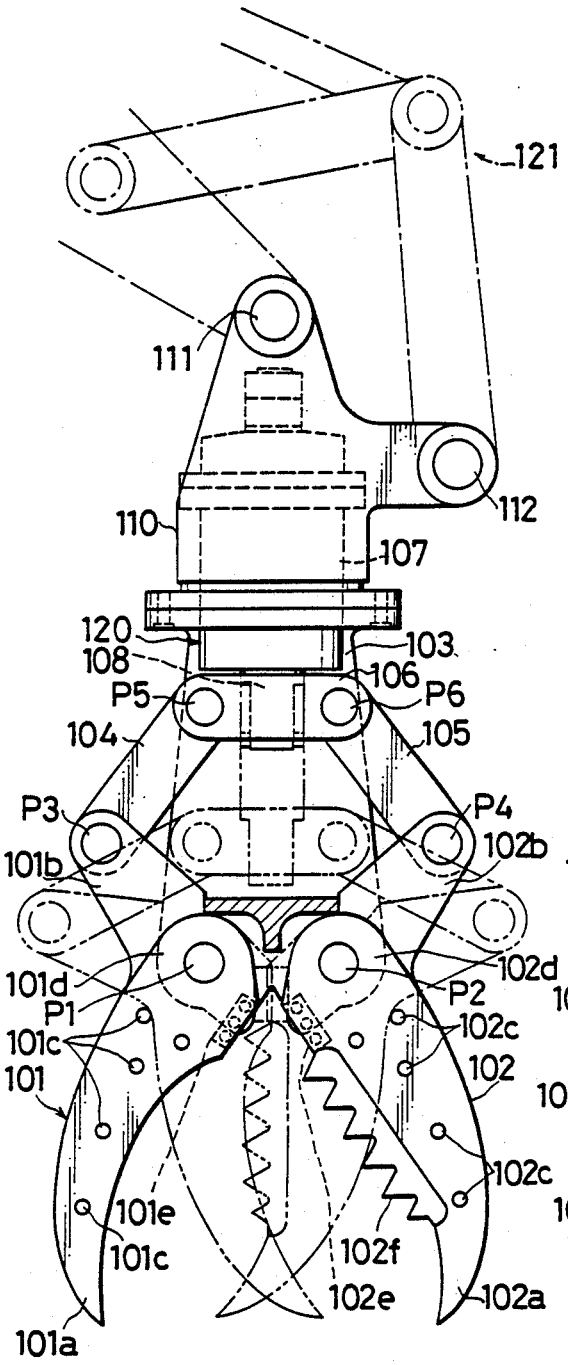
FIG. 4 is a view similar to FIG. 1, but showing a structure crushing equipment according to another embodiment of the invention, a state being indicated by the double-dotted lines in which a piston rod is retracted into a cylinder so that a pair of arms are in an open position, and a state being indicated by the solid lines in which the piston rod is extended out of the cylinder so that the pair of arms are in a closed position.
Figure 5:
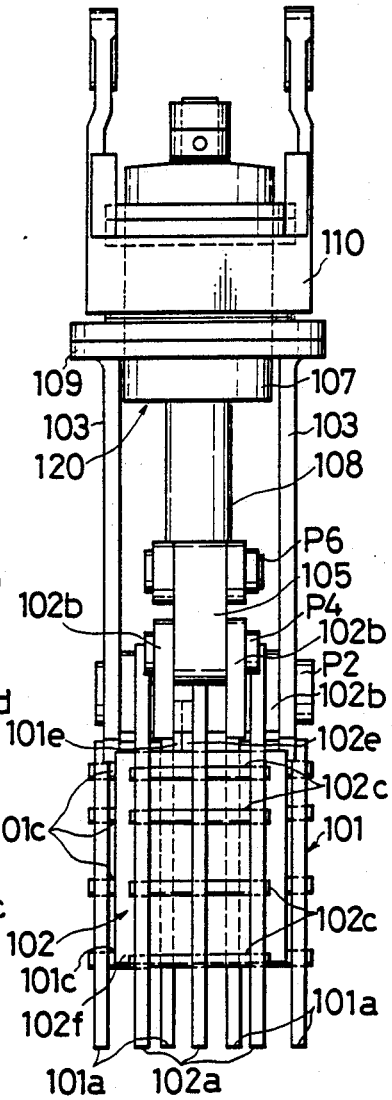
FIG. 5 is a side elevational view of the structure crushing equipment illustrated in FIG. 4, showing the state in which the piston rod is extended out of the cylinder.

Referring next to FIGS. 4 and 5, there is illustrated a structure crushing equipment according to another embodiment of the invention. FIG. 4 shows the structure crushing equipment with one of a pair of frame side plates 103 and 103 removed for clarification, similarly to FIG. 1.

The structure crushing equipment illustrated in FIGS. 4 and 5 comprises a pair of arms 101 and 102 similarly to the embodiment illustrated in FIGS. 1 through 3. The pair of arms 101 and 102 have their respective intermediate portions which are pivotally mounted to the pair of frame side plates 103 and 103 through respective pins P1 and P2 and between the frame side plates 103 and 103. The pair of frame side plates 103 and 103 are spaced a predetermined distance from each other, but are opposed to each other. The pair of arms 101 and 102 have their respective rear ends 101*b* and 102*b* which are pivotally connected respectively to a pair of links 104 and 105 through pins P3 and P4. The pair of links 104 and 105 are pivotally connected, through pins P5 and P6, to a connecting member 106 which is fixedly mounted to a piston rod 108 of a hydraulic piston-cylinder unit 120 serving as a drive source. The frame side plates 103 and 103 are fixedly mounted to a flange member 109 which is mounted to a cylinder 107 of the hydraulic piston-cylinder unit 120 for angular movement together therewith about an axis of the piston rod 108. The cylinder 107 is mounted to a bracket member 110 for angular movement together with the frame side plates 103 and 103 and the arms 101 and 102 about the axis of the cylinder 107. Attaching bores 111 and 112 in the bracket member 110 are adapted to be pivotally connected, through pins, to forward ends of respective arms of a boom 121 of a working machine such as a movable power shovel or the like.

The pair of arms 101 and 102 have their respective forward end portions which are formed respectively by a plurality of spaced arm elements 101*a* and 102*a* each in the form of a fork. The arm elements 101*a* and 102*a* are connected to each other respectively by connecting elements 101*c* and 102*c* which are fixedly secured respectively to the arm elements 101*a* and 102*a* by means of welding or the like. The arm elements 101*a* and 102*a* as well as the arms 101 and 102 have rear ends 101*b* and 102*b* which are welded respectively to annular members 101*d* and 102*d* pivotally fitted about the pins P1 and P2. Further, cutting blades 101*e* 102*e* are fixedly mounted respectively to each pair of opposed arm elements 101*a* and 102*a* at locations adjacent the pins P1 and P2. The cutting blades 101*e* and 102*e* cooperate with each other to cut reinforcement and so on. Moreover, a crushing plate 102*f* is fixedly mounted to the side of the one arm 102 which is opposed to the other arm 101. A side of the crushing plate 102*f*, which is opposed to the other arm 101, is formed with a plurality of teeth. When the pair of arms 101 and 102 are moved to the closed position, the crushing plate 102*f* cooperates with the arm elements 101*a* and the connecting elements 101*c* of the other arm 101 to clamp therebetween the concrete to crush the same. The arm elements 101*a* and 102*a* of the respective arms 101 and 102 have their respective opposed sides which are formed respectively into concave arcuate configurations, so that, when the arms 101 and 102 are moved to the closed position, the forward end portions of the respective arms 101 and 102 are intersected with each other.

The operation of the structure crushing equipment constructed as illustrated in FIGS. 4 and 5 will be described below.

When the hydraulic piston-cylinder unit 120 is actuated to retract the piston rod 108 into the cylinder 107, the arm elements 101*a* and 102*a* move respectively about the pins P1 and P2 toward the closed position as indicated by the solid lines in FIG. 4. On the other hand, when the piston rod 108 is extended out of the cylinder 107, the arm elements 101*a* and 102*a* move toward the open position as indicated by the double-dotted lines in FIG. 4. When it is desired to clamp the reinforcement and the like to take the same out, the reinforcement or the like is clamped between both the arm elements 101*a* and 102*a* or between the arm elements 101*a* and the crushing plate 102*f*, and is taken out. Since, at this time, the forward ends of the respective arms 101*a* and 102*a* are intersected with each other, it is possible to ensure clamping of the reinforcement or the like. Further, when the concrete is crushed, the arms 101 and 102 move to the open position, and the concrete lumps are scooped up by the arm 101 (hereinafter referred to as "scooping arm 101"). Subsequently, when both the arm 101 and 102 move to the closed position, the concrete lumps between the pair of arms 101 and 102 are crushed into small pieces by cooperation of the crushing plate 102*f* with the arm elements 101*a* and the connecting elements 101*c*. Furthermore, the reinforcement can be cut by the cutting blades 101*e* and 102*e*.

In the manner described above, the working after destruction of the reinforced concrete structure such as a building or the like can be carried out by the single crushing equipment. That is, separation of the concrete lumps and the reinforcement from each other and crushing of the concrete lumps into small pieces can be effected by the single crushing equipment. Moreover, the concrete lumps can be accumulated by the scooping arm 101, and only the reinforcement can be collected by the scooping arm 101, so that it is possible to efficiently carry out the post-treatment after destruction of the structure.

It is to be understood that, in the embodiment illustrated in FIGS. 4 and 5, it is not essential to arrange the piston-cylinder unit 120 in such a manner that the axis of the piston rod 107 coincides with the clamping center line between the pair of arms 101 and 102. That is, the piston-cylinder unit may be arranged perpendicularly to the clamping center line to move the pair of arms 101 and 102 between the open and closed positions. Further, although the crushing plate 102*f* is fixedly provided only on the one arm 102, both the arms 101 and 102 may be provided respectively with crushing plates. Furthermore, although the arm elements 101*a* and 102*a* are connected respectively by the rod-like connecting elements 101*c* and 102*c*, a pair of plate-like connecting members may be substituted for the rod-like connecting elements. In this case, the plate-like connecting member on the scooping arm 101 is so arranged as to be flush with the sides of the arm elements 101*a* opposed to the arm 102 so that the crushing working can be made more easy.

What is claimed is:

1. An equipment adapted to be installed on a working machine, for crushing a structure, said equipment comprising:

bracket means to be mounted to said working machine;

hydraulic piston-cylinder means having a cylinder and a piston rod and mounted to said bracket means for angular movement relative thereto about an axis of said piston rod;

frame means associated with said hydraulic piston-cylinder means for angular movement therewith about the axis of said piston rod;

a pair of opposed arms mounted to said frame means for pivotal movement relative thereto, between a closed position and an open position, toward and away from each other and toward and away from a plane including the axis of said piston rod of said hydraulic piston-cylinder means, said piston rod being operatively connected to said pair of arms for moving the same between said closed and open positions, at least one of said pair of arms having its forward end portion provided with crushing means, said crushing means on the forward end portion of said one arm cooperating with the other arm to clamp therebetween the structure for crushing the same;

passage means provided in a wall of said cylinder, wherein hydraulic fluid from hydraulic-fluid supply hose means of said working machine can be supplied into said cylinder through said passage means; and rotatable coupling means associated with said cylinder for enabling said passage means and said hydraulic-fluid supply hose means to communicate with each other even when said piston-cylinder means moves angularly about the axis of said piston rod relatively to said bracket means.

2. An equipment according to claim 1, further comprising a link mechanism arranged between said piston rod and said pair of arms for converting motion of said piston rod to pivotal movement of said pair of arms toward and away from each other.

3. An equipment according to claim 2, wherein each of said pair of arms has a rear end pivotally connected to said link mechanism and an intermediate portion of each arm is pivotally mounted to said frame means.

4. An equipment according to claim 3, wherein said pair of arms are provided respectively with the crushing means each of which is formed by a crushing blade.

5. An equipment according to claim 4, wherein said pair of arms are provided with cutting blades, respectively, which are located between said crushing blades and said intermediate portions.

6. An equipment according to claim 1, wherein said pair of arms are provided with cutting blades, respectively.

7. An equipment according to claim 1, wherein said frame means comprises a pair opposed, but spaced frame side plates, said pair of arms being arranged between said pair of frame side plates.

8. An equipment according to claim 1, wherein said wall of said cylinder is provided with a projection, and wherein said rotatable coupling means includes a ring member fitted about said projection for rotation relative thereto, said ring member being formed with port means communicating with said passage means.

9. An equipment according to claim 8, wherein said wall of said cylinder has a rear end wall section opposite to a front end wall section thereof through which said piston rod extends, said projection being provided on said rear end wall section.

10. An equipment according to claim 9, wherein said projection is formed in its peripheral surface with a pair of parallel annular grooves, wherein said passage means includes a pair of passages communicating respectively with said pair of annular grooves, and wherein said port means in said ring member includes a pair of ports capable of communicating with said pair of annular grooves, respectively.

11. An equipment according to claim 1, wherein said pair of arms have their respective sides opposed to each other, said sides being formed respectively into concave arcuate configurations so that, when said pair of arms are in said closed position, forward ends of the respective arms are intersected with each other.

12. An equipment according to claim 11, wherein said crushing means on said one arm is formed by a crushing plate fixedly mounted to said one arm, said crushing plate being formed with a plurality of teeth, and wherein the other arm is formed by a plurality of spaced arm elements and at least one connecting element for connecting said arm elements to each other.

13. An equipment according to claim 12, wherein said one arm is formed by a plurality of spaced arm elements which are connected to each other by said crushing plate.

14. An equipment according to claim 1 wherein the other arm is composed of a plurality of spaced arm elements and at least one connecting element for connecting said arm elements to each other.

15. An equipment according to claim 14, wherein said crushing means on said one arm is formed by a crushing plate fixedly mounted to said one arm, said crushing plate being formed with a plurality of teeth.

16. An equipment according to claim 14, wherein said pair of arms are additionally provided with cutting blades, respectively.

17. An equipment according to claim 14, wherein said one arm is composed of a plurality of spaced arm elements which are connected to each other by said crushing plate.

* * * * *